United States Patent [19]

Slager

[11] 4,385,476

[45] May 31, 1983

[54] WEB STIFFENER FOR LIGHT-GAUGE METAL FRAMING MEMBERS

[75] Inventor: Richard E. Slager, Prospect Heights, Ill.

[73] Assignee: United States Gypsum Company, Chicago, Ill.

[21] Appl. No.: 189,500

[22] Filed: Sep. 22, 1980

[51] Int. Cl.[3] ..... E04C 3/06

[52] U.S. Cl. ..... 52/720; 52/634

[58] Field of Search ..... 52/738, 731, 236.7, 52/241, 729, 262, 710, 481, 489, 720, 721, 634, 52/690, 696, 84

[56] References Cited

U.S. PATENT DOCUMENTS

| | | | |
|---|---|---|---|
| 1,052,670 | 2/1913 | La Francis | 52/509 |
| 1,360,720 | 11/1920 | Brown et al. | 52/731 |
| 2,392,674 | 1/1946 | Lachman et al. | 52/729 |
| 3,577,694 | 5/1971 | Omholt | 52/509 |
| 3,694,990 | 10/1972 | Pamer | 52/731 |
| 3,751,870 | 8/1973 | Vesei | 52/143 |
| 4,129,974 | 12/1978 | Ojalvo | 52/729 |

FOREIGN PATENT DOCUMENTS

| | | | |
|---|---|---|---|
| 845429 | 8/1960 | United Kingdom | 52/729 |

OTHER PUBLICATIONS

American Builder, May 1960 vol. 82, #5, p. 127.

1978 Sweet's Catalog File, Division 5, Section 3, Keene Corp., Speed Steel Structural Framing, p. 3.

1979 Sweet's Catalog File, Division 5, Section 3, Inryco, Inc., Inryco/Milcor Steel Framing Systems, pp. 8 and 21.

1979 Sweet's Catalog File, Division 5, Section 3, United States Steel Corp., Super—C Steel Framing, p. 3.

1979 Sweet's Catalog File, Division 5, Section 3, Wheeling Corrugating Company, Wheeling Steel Framing, pp. 6 and 21.

*Primary Examiner*—John E. Murtagh

*Assistant Examiner*—Michael Safavi

*Attorney, Agent, or Firm*—Robert H. Robinson; Kenneth E. Roberts; Samuel Kurlandsky

[57] ABSTRACT

A web stiffener for use with a channel-shaped framing member to inhibit web crippling is disclosed wherein said web stiffener comprises two opposing integral compression members each having a J-shaped cross-sectional configurational whereby said compression members are adapted for nested insertion opposingly faced, having longer flanges thereof overlapping within a channel of a framing member, and said members capable of being positioned at a random location along a framing member by rotation into position facilitated by inclined edges of said longer flanges, whereby opposite bearing edges of said compression members are adapted to contact opposite arms of a channel-shaped framing member for web stiffening thereof.

22 Claims, 6 Drawing Figures

WEB STIFFENER FOR LIGHT-GAUGE METAL FRAMING MEMBERS

BACKGROUND OF THE INVENTION (1) Field of the Invention

The invention relates to web stiffening means for channel-shaped framing members having utilization in light-gauge metal framing constructions.

(2) Description of the Prior Art

Light-gauge framing members, such as steel joists, are designed primarily to carry loads applied continuously or uniformly along their lengths. Such framing members are not suitable for carrying loads concentrated at a single point, especially when the bearing area is intensified at less than about twelve inches along the member. As metal thickness to height of member ratio approaches and exceeds a certain value, reinforcement is required at the point of load application to develop full load-carrying capacity without failure or damage to the joist. It has been determined that when the height divided by the thickness reaches 150 and beyond reinforcement is needed. While ratios less than 150 allow webs to provide some load cpacity, stiffening may yet be required to provide necessary load carrying capacity at point loadings.

Previous solutions to inhibit web crippling provide stiffening means for point-type loadings such as at joist supports, partitions supported on a joist and running perpendicular to it, and cantilevered loads and supports. Even though prior art solutions to web strengthening do provide adequate reinforcement, they are hindered in installation by the requirement that they must be placed within channels of the framing members prior to erection. It would therefore be desirable to be able to add reinforcement along framing members, particularly horizontal steel joists, in situ. This is especially helpful in modern highrise constructions wherein wall systems may be relocated or added to suit particular room space needs. Moreover, additional mechanical artifices such as electrical equipment, plumbing, ductwork, conduit, machinery, and other loading changes, may be required to be located or placed in areas not envisioned during initial construction. Along with being able to provide web stiffening means at random locations along joists, it has also become a concern of the industry to quickly install such means without elaborate machination. Accordingly, a simplified configuration for such purposes would be highly preferable. In attaining this goal it would also be desirable to utilize web stiffening means comprising integral compression members suitable for single or double usage to thereby provide point load concentration stiffening for light loads and heavy loads, respectively, by utilization of a similar design throughout for facile installation.

It is therefore a primary goal of the invention to provide web stiffening means for light-gauge metal framing members, especially steel joists, whereby the stiffening means may be inserted within framing member channels, which can remain in place.

It is accordingly an allied goal of the invention to attain web stiffening in already-positioned framing members by the utilization of compression members having simplified configurations for random utilization along framing members throughout a construction at concentrated point load positions.

It is another important goal of the invention to provide web stiffening means comprising compression members, which can be used individually or in doubles, to provide inhibition to web crippling at light point load concentrations or heavy point load concentrations by the same installation techniques.

It is therefore a concomitant goal of the invention to provide such a web stiffening means which can be inserted within a channel of a light-gauge framing member by simply placing the web stiffening means within a channel and rotating it into position along an erected framing construction without requiring disengagement of framing members for insertion within the channel.

SUMMARY OF THE INVENTION

In satisfying the goals of this invention a web stiffener for channel-framing members is disclosed. The stiffener comprises an integral steel compression member having a J-shaped cross-sectional configuration including a web plate having opposite side edges and opposite bearing edges, one side edge terminating in a first flange forming a shorter arm of the J-shape and the opposite side edge terminating in a second flange forming a longer arm of the J-shape. The first and second flanges extend at generally right angles to the web plate, in substantially the same direction, from substantially the full lengths of said side edges. Said flanges each having co-planar opposite bearing edges generally co-planar with an adjacent bearing edge of said web plate. The second flange including one said bearing edge terminating in an inclined edge extending between said bearing edge and a free edge distal the web plate side edge from which said second flange extends wherein said free edge has a length less than either side edge of said web plate. Whereby, the compression member is adapted for insertion at a random location along a channel-shaped framing member by rotation into position within the channel-shape facilitated by said inclined edge of said second flange and whereby said opposite bearing edges of said web plate and flanges are adapted to contact opposite arms of a channel-shaped framing member for web stiffening thereof.

In further satisfying the aims of the invention a web stiffener is disclosed for use with a channel-shaped framing member to inhibit web crippling. Said web stiffener comprises two opposing integral compression members, each having a J-shaped cross-sectional configuration including a web plate having opposite side edges and opposite bearing edges, one side edge terminating in a first flange forming a shorter arm of the J-shape and the opposite side edge terminating in a second flange forming a longer arm of the J-shape. The first and second flanges extend at generally right angles to the web plate, in substantially the same direction for substantially the full lengths of said side edges. Said flanges each have co-planar opposite bearing edges generally co-planar with an adjacent bearing edge of said web plate. Said second flange including one said bearing edge shorter than the other and terminating in an inclined edge extending between said shorter bearing edge and a free edge distal the web plate side edge from which said second flange extends. Whereby, said free edge has a length less than either side edge of said web plate. Thereby, said compression members are adapted for nested insertion, opposingly faced, with said second flanges overlapping, within a channel of a framing member. The members are capable of being positioned at a random location along a framing member by rotation into position facilitated by said inclined edge of said second flanges. Whereby the opposite bearing edges of said web plates and flanges are provided to contact opposite arms of a channel-shaped framing member for web stiffening thereof.

In furtherance of attaining the objects of the invention, a joist having increased resistance to web crippling is provided. The joist has a channel-shape including a web stiffener inserted within said joist channel. The web stiffener comprises a compression member having integral construction and having three plates forming a generally J-shaped cross-sectional configuration wherein a longer plate of the J-shape is beveled from a bearing edge inclining to a free side edge thereof whereby a corner portion is thereby removed facilitating rotational insertion of the compression member within said joist channel.

DESCRIPTION OF THE PREFERRED EMBODIMENTS

Figure 1:
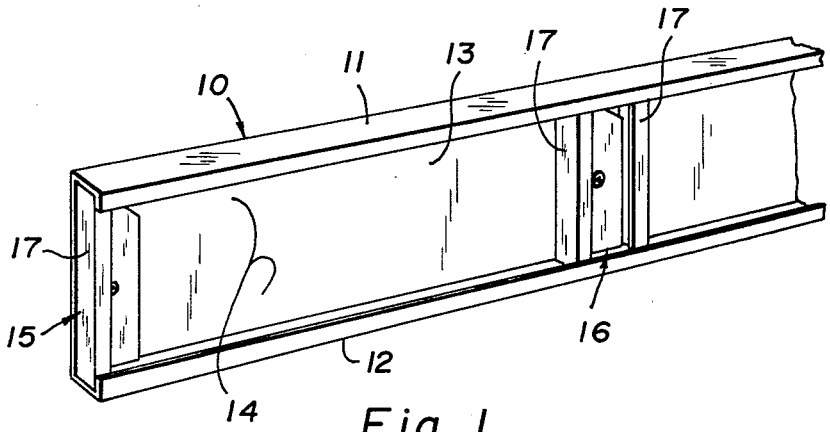
FIG. 1 is a perspective view looking along a metal channel-shaped joist having at one location a single compression member and at a second location two overlapping compression members providing web stiffening means in accordance with the preferred embodiment of this invention.

In describing this invention, which satisfies all the aims, objects, and goals set forth above, reference is first taken to FIG. 7 wherein a conventional joist 10 is shown having web stiffening means 15 and web stiffening means 16 disposed therealong to inhibit web crippling due to concentrated point loadings. Light-gauge steel framing constructions typically have thicknesses in the range from 14 to 22 gauge. Joist 10 comprises light-gauge steel formed into a channel shape having generally parallel arms 11 and 12 extending outwardly from a web 13. Arms 11 and 12, and web 13, thereby form channel 14 in which web stiffening means 15 and web stiffening means 16 are shown in their final position. Within the ambit of this invention, web crippling may be inhibited by the utilization of web stiffening means which can comprise either a single compression member 17 or two opposingly faced overlapping compression members 17. Accordingly, web stiffening means 15 comprises single compression member 17, as shown, and web stiffening means 16 comprises two compression members 17. Compression member 17 utilized for single or double construction has the same conformation. Web stiffening means 15 may be provided when lighter point loads are encountered and the use of two compression members 17 at web stiffening means 16 may be provided when heavier concentrated point loads are involved.

Figure 2:
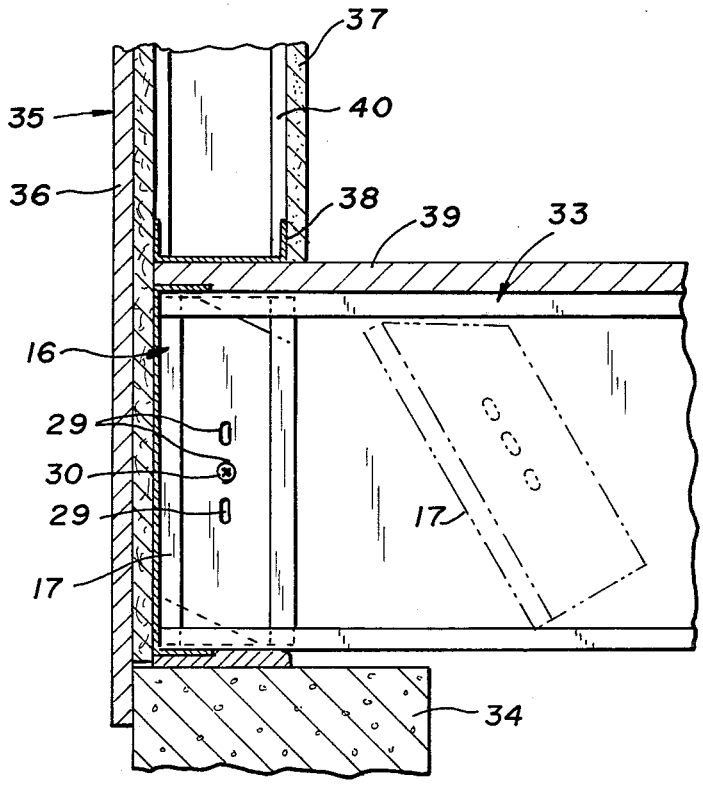
FIG. 2 is a side view showing web stiffening means positioned at a perimeter support concentrated loading in one application of the preferred embodiment of the invention.
Figure 3:
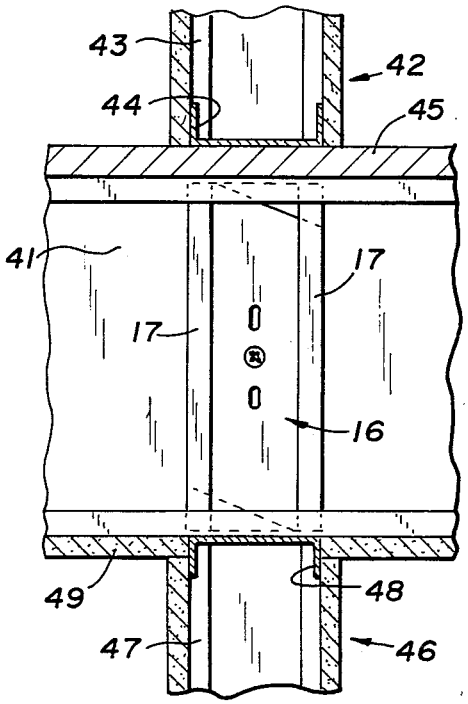
FIG. 3 is a side view of another application of the preferred embodiment of the web stiffening means of this invention at an interior support bearing location.
Figure 4:
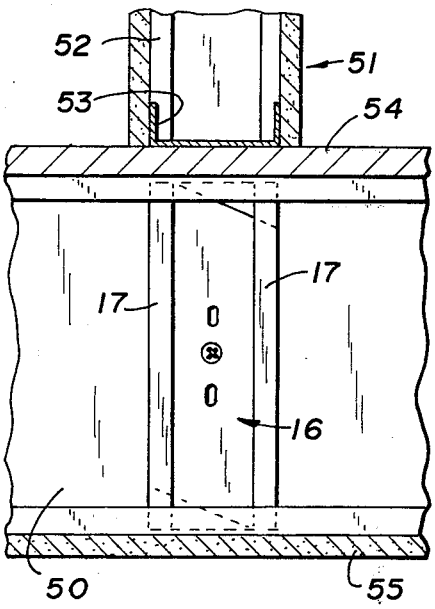
FIG. 4 is a side view of yet another common application of the web stiffening means of this invention in its preferred embodiment at an interior partition load location.

FIGS. 2, 3 and 4 illustrate three typical concentrated loading situations whereby the web stiffener of this invention may be utilized to successfully inhibit web crippling at locations at the ends, or along the span, of steel framing members. FIG. 2 shows a perimeter support situation whereby web stiffening means 16 is located at an end of joist 33. Joist 33 is supported atop foundation wall 34 having exterior wall construction 35 concentrating loading from above. Exterior wall construction 35 includes an outside wall surface 36 and inside wall 37. Inside wall 37 is a conventional partition wall construction utilizing a floor channel 38 resting atop flooring 39 and having a vertical stud 40 disposed thereabove for wall support. Light-gauge steel framing members, such as joist 33, are optimally designed to carry uniform loads across their spans and thus at a perimeter support situation, as shown in FIG. 2, web crippling can occur. Therefore web stiffening means 16 is provided to solve this problem. Shown in phantom in FIG. 2, is one compression member 17 of web stiffening means 16. Compression member 17, shown in phantom, illustrates a unique characterizing feature of this invention whereby it may be rotated into position within the channel of joist 33 while joist 33 remains in place. Such is desirable rather than having to disassemble a construction when point load concentrations are presented to an existing construction after such construction has been fully erected. In past attempts, web stiffeners would have had to have been inserted from a joist end and then slid along to the desired location. The utilization of compression member 17 for web stiffening means alleviates this problem in a superior manner. Compression members 17 are shown as they reside within joist 33 whereby each compression member 17 comprising web stiffening means 16 may be rotated into position. Upon rotation into position, compression members 17 are secured to joist webs by the utilization of screw fasteners 30 passing through aligned holes 29 of compression members 17.

In the preferred embodiments shown in FIGS. 2, 3 and 4, the bearing widths for the concentrated point loads are disclosed as being of 3½ inches (88.9 mm) along the steel framing member. This dimension corresponds to a widely used floor and ceiling runner channel width, which is 3½ inches (88.9 mm). It is to be understood, however, that a wide range of floor channels and ceiling runners, as well as other structural components, may have smaller or larger widths, but for the purpose of illustrating the preferred embodiment, this popular size, having a bearing width of 3½ inches (88.9 mm), is utilized.

Now turning to FIG. 3, another application of the web stiffener of this invention is shown at an interior support bearing location. In this location along joist 41, a partition wall 42 is shown erected thereabove utilizing stud 43 for affixation and structural requirements. Stud 43 resides within conventional floor channel 44, which is secured to flooring 45. Below joist 41, over which it transversly passes, is a similar construction being partition wall 46. Partition wall 46 utilizes vertical stud 47 affixed within ceiling runner 48. Ceiling runner 48 contacts ceiling surface 49 at a top end thereof. This loading is along the span of joist 41, wherein the concentrated point loading at an interior support situation occurs. Therefore, to inhibit web crippling of joist 41, web stiffening means 16 is provided. As noted, the width of web stiffening means 16 along joist 41 is 3½ inches (88.9 mm) to correspond with the bearing widths of floor channel 44 and ceiling runner 48. With the advent of movable partion systems, and other relocatable wall constructions, such as partition wall 42 and partition wall 46, the ability to randomly add or delete web stiffening means along a joist span is desirable. Therefore, compression members 17, which comprise web stiffening means 16, may be inserted within joist 41 at any random location therealong by the rotational installation procedure aforementioned.

FIG. 4 shows yet another common application for the web stiffening means of this invention shown at an interior partition load location. In this situation, joist 50 has partition wall 51 supported along its span creating this concentrated point loading. Partition wall 51 includes stud 52 residing within floor channel 53 which in turn is supported atop flooring 54. Shown below is ceiling surface 55 which is connected to joist 50 above. Since this location is along the span of joist 50, the insertion of compression members 17 is fully accomplished by rotational insertion thereby eliminating web crippling in a facile step which allows encountered point loading concentrations to be dealt with without needing to disassemble joist 50 from the overall building construction.

Figure 5:
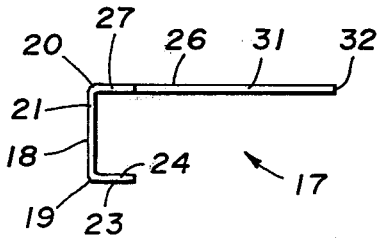
FIG. 5 is a top view of the preferred embodiment for a compression member of the web stiffening means of this invention.
Figure 6:
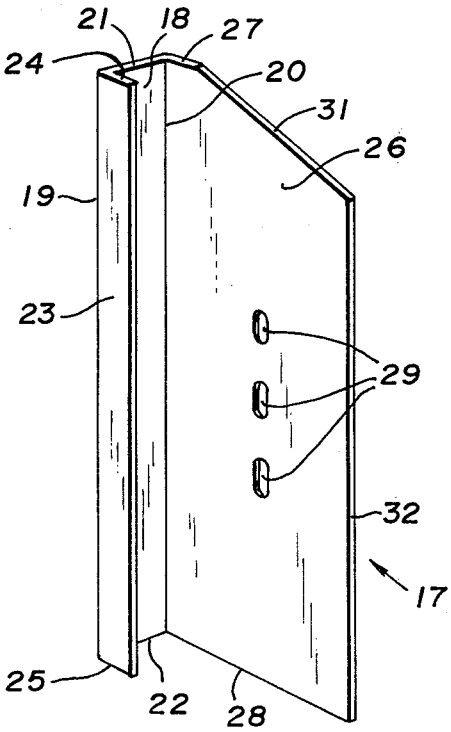
FIG. 6 is a perspective view of the compression member shown in FIG. 5.

With more specific reference to compression member 17, for web stiffening means 15, and web stiffening means 16, reference is now taken to FIGS. 5 and 6. FIG. 5 is a top view of compression member 17. FIG. 6 is a perspective view of compression member 17 illustrating the inventive characterizing features thereof. Compression member 17 is of integral construction and includes web plate 18 having opposite side edges 19 and 20. Web plate 18 further has bearing edge 21 at its upper end and bearing edge 22 at its lower end. Extending from side edge 19 is first flange 23 which may be described as the shorter flange or shorter plate of compression member 17. First flange 23 extends at generally right angles to web plate 18 from substantially the full length of side edge 19. First flange 23 includes bearing edge 24 at its upper end and bearing edge 25 at its lower end. At the opposite side of web plate 18, a second flange 26 extends from side edge 20. Second flange 26 is equally described as being the longer flange or longer plate of compression member 17. Second flange 26 extends at substantially right angles to web plate 18 from substantially the full length of side edge 20 in substantially the same direction as first flange 23 and in parallel relationship thereto. Second flange 26 includes bearing edge 27 at its upper end and bearing edge 28 at its lower end. The bearing edges of web plate 18, first flange 23 and second flange 26, are substantially co-planar at upper and lower ends of compression member 17 thereby permitting all said bearing edges to contact arms of a framing member, such as arms 11 and 12 of joist 10, shown in FIG. 1. When inserted within a channel of a joist, the bearing edges contact arms of the member thereby transmitting point load concentrations directly therethrough. Webs of joist members are thereby stiffened and do not experience the entire point loading which would otherwise lead to crippling at such intensified bearing locations. Accordingly, bearing edge 21, bearing edge 24 and bearing edge 27 reside generally co-planar; and, bearing edge 22, bearing edge 25 and bearing edge 28 reside generally co-planar at the opposite end of compression member 17.

Continuing further with FIGS. 5 and 6, it is seen that while second flange 26 is longer than first flange 23, bearing edge 27 is shorter than bearing edge 18 and is substantially the same length as bearing edge 24. This is accomplished by the inclusion of inclined edge 31 extending downwardly at an angle and terminating in free edge 32 which is preferably parallel to side edge 20. Free edge 32 is shorter than side edge 20 from which second flange 26 extends. Compression member 17 is thus shown as having second flange 26 with a triangular cutout portion along inclined edge 31. With the provision of inclined edge 31, rotational insertion within a channel of a joist may be accomplished. Upon insertion of compression members 17 within a channel of a joist to form web stiffening means 16, holes 29, which are pre-punched through second flanges 26, align and thereby facilitate screw fastening to the member, such as at web 13 of joist 10. Accordingly, second flanges 26 of compression members 17 are provided to overlap. The distance between holes 29 and side edges 20 corresponds such that overlapping second flanges 26 have free edges 32 stopping short of web plates 18. The distance between holes 29 and side edges 20 define the amount of bearing width provided for web stiffening means 16. In the preferred embodiment, a 3½ inch (33.9 mm) total bearing width is provided whereby holes 29 are located at about 1¾ inches (44.5 mm) from side edge 20. Holes 29 are shown provided at three locations faciliating screw fastening therethrough. However, within the scope of the invention only a single hole 29 can be utilized for alignment with a similar hole 29 of an overlapping compression member 17. With this configuration for compression member 17, it is seen that they are adapted to nest in pairs within a channel of a joist in inverted relationship one to another. A generally U-shape is provided when overlapped. For example, with reference to FIG. 2, the compression member 17 as shown in phantom is rotated in a clockwise direction for insertion within joist 33 with its inclined edge 31 initially adjacent an upper flange of joist 33, and the other compression member 17, being inverted, would also be rotated in a clockwise fashion, but its inclined edge 31 would be initially adjacent a lower flange of joist 13. Therefore, bearing edges 28 of the compression members 17 reside at opposite arms of a joist. Members 17 orient opposingly faced in 180° rotational relationship to each other. In the preferred embodiment, bearing edges 21 and 22 of web plate 18 are about twice the length of bearing edges 24 and 25 of first flange 23, and twice the length of bearing edge 27 of second flange 26. However, other configurations may be provided well within the spirit of the invention. Similarly, the height of compression member 17 may be provided to vary as required for the heights of joists encountered. Typically, joists, and other channel-shaped framing members, have heights in a range of from about 3½ inches (88.9 mm) to about 13½ inches (342.4 mm) for light-gauge steel framing constructions. Thus, the height of compression member 17, which is the distance between the upper and lower bearing edges, would be provided to match the interior height between arms of a joist to facilitate contact between the bearing edges and joist arms for web stiffening thereof. The distance between holes 29 and free edge 32 is less than the distance between holes 29 and side edge 20 thereby permitting overlapping without a free edge 32 contacting a web plate 18 of an opposingly faced compression member 17. This dimension is preferably 1 9/16 inches (39.7 mm)

when a 3½ inch (88.9 mm) total bearing width is desirable for web stiffening means 16. The affixation of second flanges 26 to joist webs is desirably accomplished by the utilization of pan head screws well know to the construction industry.

In viewing FIG. 6, in conjunction with FIG. 2, screw fasteners 30 are provided for insertion through holes 29 which are aligned for engagement to joist webs. For the typical bearing width installation, the lengths of bearing edges 24, 25, and 27, are about ⅝ inches (15.9 mm) and bearing edges 21 and 22 of web plate 18 being about 1¼ inches (31.8 mm). The lengths of bearing edges 21 and 22 preferably being about twice the lengths of the bearing edges 24, 25, and 27. In the preferred embodiment, the height of free edge 32 is about from one inch to about three inches less than the height of web plate 18. The preferred thickness for compression member 17 is 14 gauge, which is about 0.075 inches (1.90 mm). However, it is envisioned that for use in light-gauge steel framing, compression member 17 may be made of steel in a range of from about 14 gauge to about 18 gauge (0.075 to 0.048 inches) (1.90 to 1.22 mm).

In attaining the goals set forth, it has been determined that when a framing member has a height to thickness ratio of about 150 and greater, the web cannot withstand even relatively small point loads and therefore web stiffening means are required. Web stiffening means 15 and web stiffening means 16 are suited for utilization with light-gauge framing members of conventional sizes ranging from about 14 gauge to about 22 gauge (0.075 to 0.030 inches) (1.90 to 0.76 mm). The increased strength provided by this invention is shown by the following Tables 1 and 2. Three loading tests were run on stiffened joist for each type listed and the average noted in the Tables. The maximum loading for unstiffened joists was calculated pursuant to AISI Specification Section 3.5 wherein stiffening is mandated when h/t reaches or exceeds 150. The web stiffening mode analyzed was two compression members 17 forming previously described web stiffening means 16 for comparison with an unstiffened joist. As, previously discussed, a widely used width for a floor channel or ceiling runner is 3½ inches (88.9 mm). Therefore, the Tables reflect results using this dimension wherein compression members have a distance between web plates and holes of 1¾ inches (44.5 mm) thereby providing a total bearing width of 3½ inches (88.9 mm). Table 1 indicates the maximum loading unstiffened and stiffened for end reactions or concentrated loads at outer ends of cantilevers, such as the situation shown in FIG. 2. Table 2 indicates maximum loading with respect to reactions of interior supports or concentrated loads along a span, such as illustrated in FIGS. 3 and 4.

TABLE 1

LOAD TESTS
(End Reactions or Concentrated Loads at Outer Ends of Cantilevers)

| Steel Joists* | | | Maximum Load** (No Stiffener) | | Maximum Load (With Steel Stiffener)* | | Design Load (Safety Factor = 2.0) | |
|---|---|---|---|---|---|---|---|---|
| Height | Gauge | h/t | Kips | kN | Kips | kN | Kips | kN |
| 13.5 in. (343mm) | 14 | 180 | *** | *** | 19.105 | 85.02 | 9.552 | 42.51 |
| 11.5 in. (292mm) | 14 | 153 | *** | *** | 18.682 | 83.13 | 9.341 | 41.57 |
| 9.5 in. (241mm) | 14 | 127 | 0.923 | 4.11 | 17.913 | 79.71 | 8.956 | 39.85 |

TABLE 1-continued

LOAD TESTS
(End Reactions or Concentrated Loads at Outer Ends of Cantilevers)

| Steel Joists* | | | Maximum Load** (No Stiffener) | | Maximum Load (With Steel Stiffener)* | | Design Load (Safety Factor = 2.0) | |
|---|---|---|---|---|---|---|---|---|
| Height | Gauge | h/t | Kips | kN | Kips | kN | Kips | kN |
| 7.5 in. (191mm) | 14 | 100 | 1.079 | 4.80 | 19.920 | 88.64 | 9.960 | 44.32 |
| 11.5 in. (292mm) | 16 | 192 | *** | *** | 17.976 | 79.99 | 8.988 | 39.99 |
| 9.5 in. (241mm) | 16 | 158 | *** | *** | 16.909 | 75.25 | 8.454 | 37.62 |
| 7.5 in. (191mm) | 16 | 125 | 0.658 | 2.93 | 18.320 | 81.52 | 9.160 | 40.76 |

*Fy = 40 Ksi (275.79MPa)
**Calculated pursuant to AISI Specification Section 3.5.
***Stiffening required for h/t equal to, or greater than, 150.

TABLE 2

LOAD TESTS
(Reactions of Interior Supports or Concentrated Loads Along the Span)

| Steel Joists* | | | Maximum Load** (No Stiffener) | | Maximum Load (With Steel Stiffener) | | Design Load (Safety Factor = 2.0) | |
|---|---|---|---|---|---|---|---|---|
| Height | Gauge | h/t | Kips | kN | Kips | kN | Kips | kN |
| 13.5 in. (343mm) | 14 | 180 | *** | *** | 19.105 | 85.02 | 9.552 | 42.51 |
| 11.5 in. (292mm) | 14 | 153 | *** | *** | 18.682 | 83.13 | 9.341 | 41.57 |
| 9.5 in. (241mm) | 14 | 127 | 1.488 | 6.62 | 17.913 | 79.71 | 8.956 | 39.85 |
| 7.5 in. (191mm) | 14 | 100 | 1.589 | 7.07 | 19.920 | 88.64 | 9.960 | 44.32 |
| 11.5 in. (292mm) | 16 | 192 | *** | *** | 17.976 | 79.99 | 8.988 | 39.99 |
| 9.5 in. (241mm) | 16 | 158 | *** | *** | 16.909 | 75.25 | 8.454 | 37.62 |
| 7.5 in. (191mm) | 16 | 125 | 0.977 | 4.35 | 18,320 | 81.52 | 9.160 | 40.76 |

*Fy = 40 Ksi (275.79MPa)
**Calculated pursuant to AISI Specifications Section 3.5.
***Stiffening required for h/t equal to, or greater than, 150.

The Tables are provided to particularly highlight the problem with joists having h/t ratios of around 150 and greater. When h/t gets well above 150, the ability of the web to withstand concentrated point loading is significantly diminished and stiffening is mandated. The excellent results with the utilization of the web stiffener means herein disclosed is illustrated by the column listing the maximum loading with steel stiffening. Even utilizing design loads, incorporating a safety factor of 2.0, very significant increases in loading can be obtained. It is to be noted that unstiffened joists have greater loading capacity along their spans (Table 2) than at outer ends (Table 1). This is due to some additional rigidity from the web extending on both sides of the loading in the first situation, but only at one side in the latter. When using the web stiffening means of this invention, most of the load is transmitted through the compression members and the maximum loading for either situation is the same, since the web of the joist experiences negligible loading and becomes an insignificant factor.

While the disclosure herein focuses on typical situations, such as at a perimeter support, an interior support bearing, and an interior partition load location, innumerable types of load concentrations are equally suited for practice with this invention. Therefore, within the spirit and broad scope of the invention, a wide variety of point loadings, as well as modifications to the preferred embodiments shown herein, are to be considered within the ambit of this invention and claims appended hereto. While the preferred embodiment utilizes two overlapping compression members 17 for the web stiffening means, it is fully expected that for lesser point load concentrations, an individual compression member 17 may be utilized. It has been determined that a single compression member 17 may be provided to obtain approximately one half of the maximum loading capability of the double overlapping mode.

Accordingly, it is seen that the web stiffening means disclosed herein satisfies all the objects and goals set forth above. Simplified installation by rotational insertion at a random location along a framing member is a significant characterizing feature in addition to the excellent stiffening properties provided. The utilization of conventional-gauge steel for compression members 17 affords ease of installation and manufacture. One skilled in the art will readily appreciate the novel and inventive concept provided herein.

What is claimed is:

1. A web stiffener for channel-shaped framing members, said stiffener comprising an integral steel compression member having a J-shaped cross-sectional configuration including a web plate having opposite side edges and opposite bearing edges with the length of said side edges being substantially greater than the length of said bearing edges, one side edge terminating in a first flange forming a shorter arm of the J-shape and the opposite side edge terminating in a second flange forming a longer arm of the J-shape said first and second flanges extending at generally right angles to said web plate, in substantially the same direction, from substantially the full lengths of said side edges, said flanges each having co-planar opposite bearing edges generally co-planar with an adjacent bearing edge of said web plate said second flange having one said bearing edge shorter than the other and terminating in an inclined edge extending between said shorter bearing edge and a free edge distal the web plate side edge from which said second flange extends wherein said free edge has a length less than either side edge of said web plate whereby said compression member is adapted for insertion at a random location along a channel-shaped framing member by rotation into position within the channel-shape facilitated by said inclined edge of said second flange, whereby said opposite bearing edges of said web plate and flanges are adapted to contact opposite arms of a channel-shaped framing member for web stiffening thereof.

2. A web stiffener as claimed in claim 1 wherein said second flange includes said free edge in parallel relationship with the web plate side edge from which said second flange extends, whereby said second flange has a removed corner configuration along said inclined edge extending between said shorter bearing edge and free edge.

3. A web stiffener as claimed in claim 2 wherein the shorter bearing edge of said second flange has a length no less than the length of either bearing edge of said first flange.

4. A web stiffener as claimed in claim 2 wherein the shorter bearing edge of said second flange has about the same length as either bearing edge of said first flange.

5. A web stiffener as claimed in claim 4 wherein the the bearing edges of said web plate are each about twice the length of the shorter bearing edge of said second flange.

6. A web stiffener as claimd in claim 1 wherein the second flange includes at least one hole therethrough facilitating screw-fastener passage therethrough for affixation to a framing member.

7. A web stiffener for use with a channel-shaped framing member to inhibit web crippling, said web stiffener comprising two opposing integral compression members each having a J-shaped cross-sectional configuration including a web plate having opposite side edges and opposite bearing edges, one side edge terminating in a first flange forming a shorter arm of the J-shape and the opposite side edge terminating in a second flange forming a longer arm of the J-shape said first and second flanges extending at generally right angles to said web plate, in substantially the same direction, from substantially the full lengths of said side edges, said flanges having co-planar opposite bearing edges generally co-planar with an adadjacent bearing edge of said web plate said second flange having one said bearing edge shorter than the other and terminating in an inclined edge extending between said shorter bearing edge and a free edge distal the web plate side edge from which said second flange extends, wherein said free edge has a length less than either side edge of said web plate whereby said compression members are adapted for nested insertion, opposingly faced, with said second flanges overlapping, within a channel of a framing member, said members capable of being positioned at a random location along a framing member by rotation into position facilitated by said inclined edges of said second flanges, whereby the opposite bearing edges of said web plates and flanges are provided to contact opposite arms of a channel-shaped framing member for web stiffening thereof.

8. A web stiffener as claimed in claim 7 wherein said web stiffener comprises said compression members in inverted relationship whereby said shorter bearing edges of said second flanges are positioned at opposite sides of said web stiffener.

9. A web stiffener as claimed in claim 7 wherein said second flange includes said free edge in parallel relationship with the web plate side edge from which said second flange extends whereby said second flange has a removed corner configuration along said inclined edge extending between said shorter bearing edge and free edge.

10. A web stiffener as claimd in claim 9 wherein the shorter bearing edge of said second flange has a length no less than the length of either bearing edge of said first flange.

11. A web stiffener as claimed in claim 9 wherein the shorter bearing edge of said second flange has about the same length as either bearing edge of said first flange.

12. A web stiffener as claimed in claim 11 wherein the bearing edges of said web plate are each about twice the length of the shorter bearing edge of said second flange.

13. A joist having increased resistance to web crippling, said joist having a channel-shape including a web stiffener inserted within said joist channel, said web stiffener comprising a compression member having integral construction and having three plates forming a generally J-shaped cross-sectional configuration wherein a longer plate of the J-shape is bevelled from a bearing edge inclining to a free side edge thereof whereby a corner portion is thereby removed facilitating rotational insertion of the compression member within said joist channel.

14. A channel-shaped joist having web stiffening means to enhance resistance to web crippling at a location therealong of highest reaction, said web stiffening means positioned within the channel of said joist and comprising, a pair of overlapping compression members each having integral construction including three plate portions, two parallel plates and one transverse plate interconnecting therebetween, said compression members each having a generally J-shaped cross-sectional configuration, said members opposingly facing with longer plates of the J-shapes overlapping, said longer plates having corner portions thereof removed forming bevelled edges facilitating rotational insertion within said joist channel.

15. A channel-shaped framing member having web stiffening means located therealong at a position of concentrated loading, said web stiffening means comprising a pair of substantially identical, oppositely facing, compression members residing inverted with respect to each other within said channel, said member comprising, a generally J-shaped cross-sectional configuration and integral construction having a web plate interconnecting a long flange to a short flange thereby forming the J-shape, said long flange, web plate and short flange having generally co-planar upper and lower bearing edges contacting arms of said framing member, said long flanges each having a generally triangular corner position removed therefrom forming an inclined edge facilitating rotation into position along said framing member, wherein said compression members are positioned having said longer flanges overlapping.

16. A channel-shaped framing member and web stiffening means as claimed in claim 15 wherein each said compression member includes said longer and shorter flanges extending at generally right angles to said web plate, in substantially the same direction, from substantially the full lengths of opposite side edges of said web plate, said longer flanges having one said bearing edge shorter than the other and terminating at said inclined edge extending between said shorter bearing edge and a free edge distal the web plate side edge from the web plate side edge from which said longer flange extends, wherein said free edge has a length less than either side edge of said web plate.

17. A channel-shaped framing member and web stiffening means as claimed in claim 16 wherein the shorter bearing edge of said longer flange has a length no less than the length of either of the upper or lower bearing edges of said shorter flange.

18. A channel-shaped framing member and web stiffening means as claimed in claim 16 wherein the shorter bearing edge of said longer flange and said upper and lower bearing edges of said shorter flange are of substantially the same length.

19. A channel-shaped framing member and web stiffening means as claimed in claim 18 wherein the upper and lower bearing edges of said web plate are about twice the length of the shorter bearing edge of said long flange.

20. A channel-shaped framing member and web stiffening means as claimed in claim 15 wherein the channel-shaped framing member includes a web with parallel first and second arms extending therefrom to form said channel-shape, wherein the shorter bearing edge of the longer flange of one compression member contacts the first arm and the shorter bearing edge of the longer flange of the oppositely faced compression member contacts the second arm.

21. A channel-shaped framing member and web stiffening means as claimed in claim 20 wherein the longer flanges of said compression members are overlapping, extending in opposite directions, with at least one hole through each in corresponding alignment with the other and accommodating a fastener therethrough affixing said web stiffening means to said framing member.

22. A channel-shaped framing member and web stiffening means as claimed in claim 21 wherein the overlapping longer flanges reside adjacent the web of the framing member with one said longer flange of a compression member in planar contact therewith, whereby said fastener extends through said longer flanges and web of the framing member.

* * * * *